US005860514A

United States Patent [19]

Beattie et al.

[11] Patent Number: 5,860,514

[45] Date of Patent: Jan. 19, 1999

[54] ACTUATOR MECHANISM FOR AN ALTERNATE ACTION SWITCH

[75] Inventors: Glen H. Beattie; Dale R. Jesselson, both of Livonia, Mich.

[73] Assignee: UT Automotive Dearborn, Inc., Dearborn, Mich.

[21] Appl. No.: 746,352

[22] Filed: Nov. 8, 1996

[51] Int. Cl.[6] ..... H01H 13/50; H01H 3/02

[52] U.S. Cl. ..... 200/523; 200/525; 200/529

[58] Field of Search ..... 200/16 R, 16 B, 200/16 E, 17 R, 18, 520–529, 6 A, 433–439

[56] References Cited

U.S. PATENT DOCUMENTS 4,300,026 11/1981 Bull ..... 200/525
4,520,242 5/1985 Kopsho, Jr. ..... 200/6 A
4,736,081 4/1988 Sorrells ..... 200/525
4,916,269 4/1990 Spazierer et al. ..... 200/529 X
4,929,806 5/1990 Furuhashi et al. ..... 200/61.54
5,136,132 8/1992 Kitchen ..... 200/525

*Primary Examiner*—J. R. Scott
*Attorney, Agent, or Firm*—Howard & Howard

[57] ABSTRACT

An actuator mechanism for alternate action switching devices having at least two states includes a housing structure and an actuator member slidably engaged therewith. In order to move the switching device between states, the actuator member has a contoured surface that moves along and remains in constant sliding engagement with a correspondingly contoured surface on the housing. A biasing member urges the actuator surface into the housing surface throughout operation. This provides noiseless operation of the switching device.

9 Claims, 3 Drawing Sheets

ACTUATOR MECHANISM FOR AN ALTERNATE ACTION SWITCH

TECHNICAL FIELD

This invention relates to switches, and more particularly, to an actuation mechanism for alternate action switches.

BACKGROUND OF THE INVENTION

Alternate action switches are toggle switches which can make alternate electrical connections upon actuation. These switches are used in, for example, automotive applications for functions such as headlight beam change and hazard warning lights.

Referring to FIG. 1A, a conventional alternate action switch 10 includes a two piece housing 12, a two state switching device 14, an actuator mechanism 16, and a user interface (not shown).

The housing 12 supports the components of the switch 10. When the pieces of the housing 12 are joined a chamber 20 and a bore 22 are formed. Each piece of the housing 12 has a hole 24 disposed therethrough. A translational axis TA extends through the center of the bore 22. An operational axis OA extends through the holes 24. The operational axis OA is perpendicular to the translational axis TA.

The switching device 14 is mounted within the chamber 20 of the housing 12, and has two states which are exclusively and alternately selectable. The switching device 14 includes a carrier 25, a contactor 26, a first terminal 27, a second terminal 28, and a third terminal 29.

The carrier includes an orientation axis X, a post 30, and a contact surface 32. The orientation axis X references the angular orientation of the carrier 25 and the contactor 26.

Referring to FIGS. 1A and 1B, the post 30 is centrally disposed through the carrier 25 and engages the holes 24 in the housing 12, so that the carrier 25 is rotatably mounted to the housing 12. The post 30 is aligned with the operational axis OA.

The contact surface 32 generally has a w-shape, with a peak P and two valleys V1, V2 joining at the peak P. Each state of the switching device 14 corresponds to one of the valleys V1 or V2 on the carrier 25.

The copper contactor 26 is fixedly coupled to the carrier 25 and includes two spaced protrusions 26*a*. The terminals 27, 28, and 29 are also copper and are mounted on the housing so that they can be engaged by the contactor 26. The first terminal 27 is positioned to the left of the axis OA. The second and third terminals 28 and 29 are aligned one above the other to the right of the axis OA.

The actuator mechanism 16 includes a housing structure 34, an actuator member 36, and a helical compression spring 38.

The housing structure 34 includes a housing cup 40 and a cap 42. The housing cup 40 is a tube shaped structure having a cylindrical cavity 44, an open end 46 as shown in FIG. 1A, an opposed end wall 48, and a plurality of retention holes 50.

The end wall 48 has an aperture 52 centrally disposed therethrough. The end wall 48 further has an internal flat seating surface 54 which circumscribes the aperture 52. The holes 50 are circumferentially spaced adjacent the open end 46.

The actuator member 36 includes a torus shaped actuator base 56, and an actuator arm 58 extending from the base 56.

The base 56 has two flat surfaces. The arm 58 has a center axis C which extends along the arm lengthwise. The actuator member 36 is disposed in the housing cup 40. The arm 58 extends through the aperture 52, and the base 56 rests against the seating surface 54. The helical compression spring 38 rests on the base 56.

The cap 42 includes a top 60 and a cylindrically shaped body 62 extending from the top 60, so that the cap 42 is generally T-shaped.

The cap 42 is disposed on the housing cup 40, so that the top 60 covers the housing cup 40, and the body 62 partially extends into the cavity 44. The protrusions 64 on the cap 42 extend into the holes 50 in the housing cup 40, so that the cap 42 is secured to the cup 40. The body 62 includes circumferentially spaced protrusions 64 and a reaction surface 66.

The reaction surface 66 physically limits how far the spring 38 and actuator member 36 can recede into the cavity 44. The spring 38 seats against the reaction surface 66, and exerts a force on the actuator base 56, urging the lower surface of the actuator base 56 into contact against the seating surface 54.

The housing cup 40 is inserted into the bore 22 of the housing 12. The actuator member is in a center or neutral position, which means the spring 38 has caused the center axis C of the actuator arm 58 to be aligned with the axis TA. The actuator member is in an off-center position when the axis C is not aligned with the axis TA.

The user interface (not shown) can be any means appropriate for effectuating the necessary translation of the actuator mechanism 16 to be discussed below. The effort applied by the user interface on the actuator mechanism is illustrated by the arrow UI. For example, the user interface can be a push button or a lever, which connects to the cap 42 in a conventional manner.

Referring to FIG. 1B, unactuated the actuator mechanism 16 has an initial position A1. The carrier 25 has an initial position C1, where peak P is to the right of the translational axis TA. In these initial positions the actuator mechanism 16 is in a retracted position, so that the actuator arm 58 is centered and spaced from the carrier 25.

Referring to FIGS. 1A and 1C, application of effort UI by the user interface (not shown) causes axial motion of the housing structure 34 along the axis TA, as represented by the arrow M. The actuator arm 58 engages the sloped contact surface 32 on the carrier 25, slides into the valley V1, and exerts a force on the carrier 25, via the valley V1. The carrier 25 and the contactor 26 rotate in the direction of the valley V1, as illustrated by the arrow R.. to a position C2. The peak P has rotated from right side of axis TA to the left side. The center axis C of the actuator arm 58 is not aligned with the translational axis, and the base 56 is spaced from the seating surface 54. This causes the switch to be in its first state, where the protrusions 26*a* of the contactor 26 are in contact with the first and third terminals 27 and 29. Thus, making a first electrical connection between the terminals 27 and 29, and other electrical components (not shown). Thus, the carrier 25 translates force provided by the actuator mechanism 16 along the axis TA to a force operating with respect to the axis OA.

When the user interface (not shown) is released, the housing structure 34 will retract along axis TA and return to its initial position A1 (as shown in FIG. 1D). The actuator member 36 will be urged by the spring 38 to return to the centered position. However, the carrier will remain in position C2.

Due to previous rotation of the carrier 25, the peak P is to the left side of the axis TA. Referring to FIG. 1E, a subsequent actuation by applying effort UI, will again cause the housing structure 34 to move along the axis TA. The actuator arm 58 engages the contact surface 32, slides into the valley V2, and exerts a force to rotate the carrier 25 and the contactor 26 in a direction R2 to position C1. The peak P is to the right of the translational axis TA. The center axis C of the actuator arm 58 is not aligned with the translational axis TA, and the base 56 is spaced from the seating surface 54. This causes the switch to be in its second state, where the protrusions 26*a* of the contactor 26 are in contact with the first and second terminals 27 and 28. Thus, making a second electrical connection between the terminals 27 and 28, and other electrical components (not shown).

Upon release of the user interface UI, the housing structure 34 will retract from the carrier 25 to its initial position A1, and the actuator member 36 will again return to the centered position. The carrier 25 will remain in the initial position C1.

Successive actuations will bring about alternate selection of the carrier and contactor's two positions C1 and C2 in the above described manner, consequently causing alternate engagement of the two states of the switching device 14 (as shown in FIG. 1A). The actuator member 36 will return to the initial and centered position after each switch actuation.

The conventional actuation mechanism 16 has undesirable results when used. Referring to FIGS. 1C and D, after each actuation, when the housing structure 34 retracts from the carrier 25 and the actuator member 36 returns to its centered position, there is an audible noise. This noise results from the actuator base 56 being forced by the spring 38 back against the seating surface 34.

As the level of noise generated is dependent upon the amount of force exerted by the spring 38, the noise could be lessened by using a less powerful spring. However, the spring 38 must meet minimum functional requirements such that it is strong enough to reseat the actuator base 56, and it is sturdy enough to withstand repetitive actuations associated with normal use. Use of a weaker spring would decrease the functional capability of the spring. A dampening lubricant can also be used to minimize noise. This switch is generally in an environment where its noisy operation will be readily discernible to the user, which may contribute to a lack of perceived quality by the customer.

Referring to FIG. 1B, the disc shape of the actuator base 56 allows for off-center seating when in the unactuated position. The disc must necessarily be of smaller dimensions than the cavity 44 which contains it, so as to allow unrestricted travel of the actuator base 56 during actuation. As a result, the small disk may return after actuation to an off-centered position.

Consequently, off-center seating results in a differential in required actuation efforts, where it will randomly require more or less effort on the user interface (not shown) for switch actuation. The effort required will be depend on the position of the actuator member 36 relative to the translational axis TA. As the actuator member 36 seats farther from the translational axis TA, the efforts required increase proportionately. This differential in actuation efforts is noticeable to the user and is an objectionable characteristic.

Assembly of the actuator mechanism 16 is also difficult. The design of the actuator mechanism requires that the actuator member 36 is oriented concentrically within the cavity 44, such that the actuator arm 58 aligns with the aperture 52 in the housing cup 40. Achieving the proper positioning is time consuming, and increases assembly cost.

Therefore what is needed in the art is an improved actuation mechanism, which emits minimal noise during operation, increases accuracy in center repositioning subsequent to actuation, and further, a simplified assembly process.

SUMMARY OF THE INVENTION

According to the present invention, an actuator mechanism for use with a switching device having two positions includes a housing structure, an actuator member, and a centering means. The housing structure includes a cavity and a end wall for defining the cavity. The end wall has a first surface. The actuator member includes an actuator base having a second surface and an arm extending from the second surface.

The actuator member is disposed in the housing structure so that the arm extends through the aperture and the first and second surfaces mate. The centering means is also disposed within the housing structure and urges the actuator member into slidable engagement with the end wall. The centering means also centers the arm within the aperture.

In order to move the switching device between positions, the actuator arm engages the switching device, the second surface slides along said first surface, and the actuator arm moves the switching device between positions. Upon disengagement of the actuator arm with the switching device the centering means centers the actuator arm within the aperture. By sliding the actuator member relative to the housing structure, the actuator mechanism noiselessly and smoothly transitions between centered and engaged positions.

According to one embodiment of the present invention the first and second surfaces have complimentary arcuate configurations, which are hemispherical. Although designed originally for automotive applications, the invention may be adapted and utilized in a variety of other applications.

The foregoing and other objects, features and advantages of the present invention will become more apparent in light of the following detailed description of exemplary embodiments thereof, as illustrated in the accompanying drawings.

BEST MODE FOR CARRYING OUT AN EMBODIMENT OF THE INVENTION

Figure 2A:
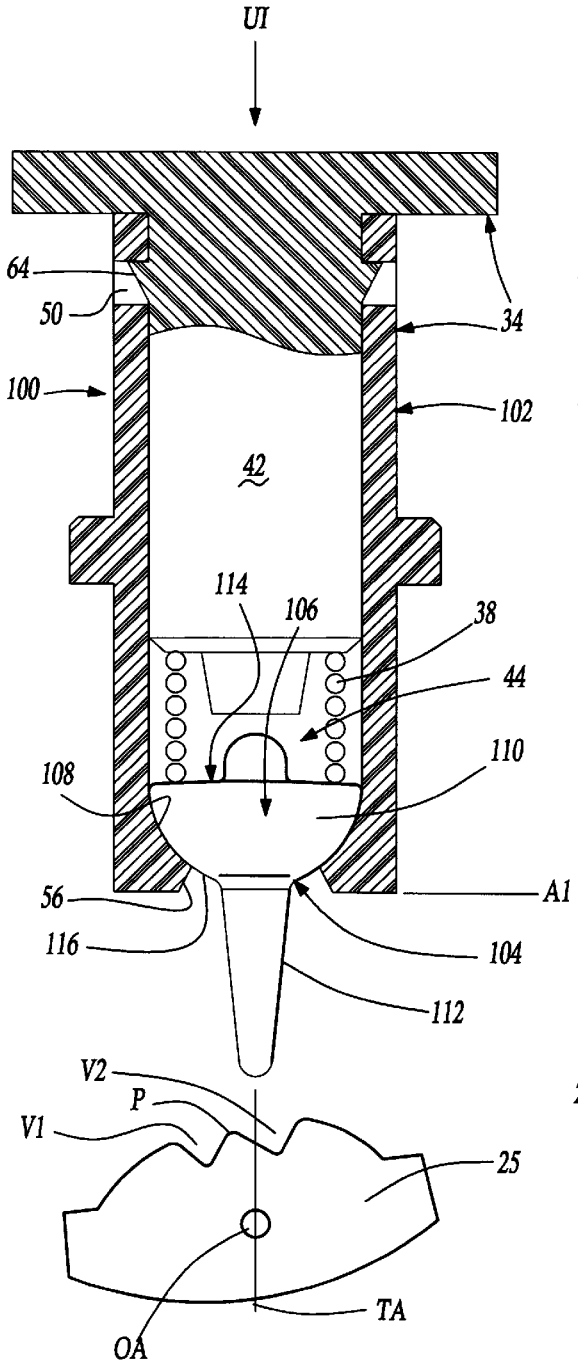
FIGS. 2A and 2B are cross sectional views of an actuator mechanism of the present invention in various modes of operation.
Figure 2B:
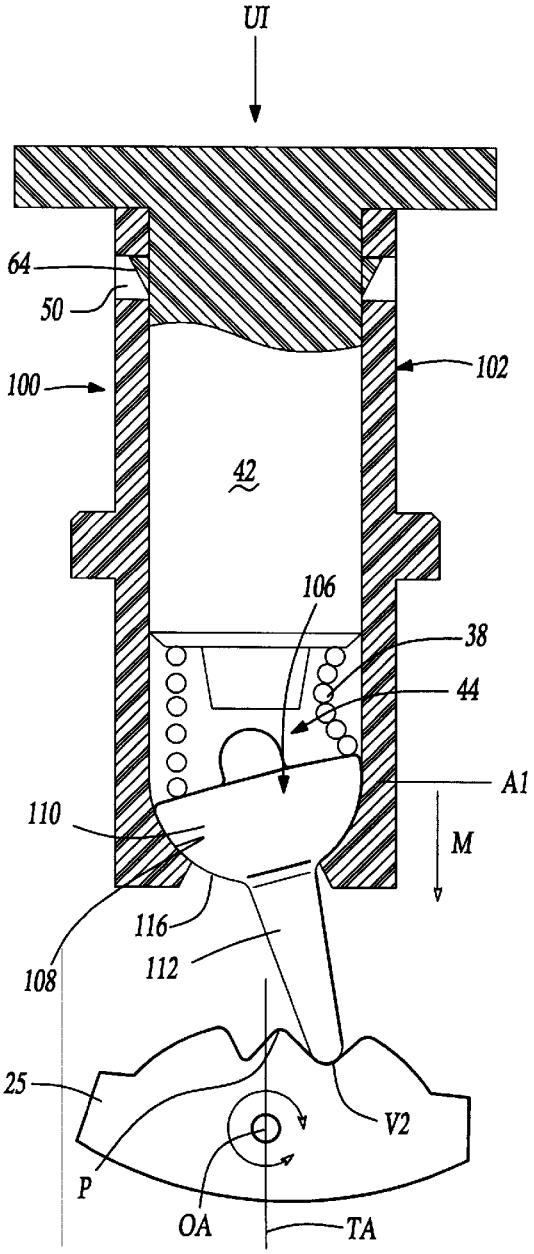

Referring to FIGS. 2A and 2B, an actuator mechanism 100 has a modified housing cup 102 and actuator member 104. The housing cup 102 has been modified so that the end wall 106 has an arcuate internal seating surface 108.

The actuator member 104 comprises a modified actuator base 110 and an actuator arm 112. The actuator base 110 has a flat surface 114 and an opposed arcuate lower surface 116. The arcuate lower surface 116 has a configuration that is complementary to the arcuate seating surface 108. The actuator arm 112 extends from the arcuate lower surface 116.

The actuator mechanism 100 is assembled by inserting the actuator member 104 in the cavity 44 of the housing cup 102. The actuator arm 112 extends through the aperture 56 in the housing cup 102. The arcuate lower surface 116 rests against the arcuate seating surface 108. The surfaces 108 and 116 form a sliding interface. The plug 42 and the spring 38 are a centering means. For the one described embodiment, the arcuate surfaces 108 and 116 are hemispherical.

In the assembled configuration, the actuator mechanism 104 operates similarly to the one described hereinabove, however, with a number of advantages. The principal advantage is that noise is minimized. By maintaining constant sliding contact between the arcuate actuator base 110 and the seating surface 108, smooth virtually noiseless operation results because there is no impact between parts during actuation.

The arcuate shape of the actuator base 110 and seating surface 108 allow for ease of assembly. Upon dropping the actuator member 104 into the cavity 44 of the housing cup 102 actuator arm 112 first, the actuator arm 112 slides into the aperture 56, and the arcuate surfaces 108 and 116 mate. Thus the actuator arm 34 need not be specially oriented during assembly, so assembly is easier, quicker and cheaper.

The actuator mechanism 100 ensures accurate centering of the actuator member 104 due to the symmetrical geometry of the arcuate surfaces 108 and 116. The helical compression spring 38 exerts force on the flat surface 114 of the actuator base 110 forcing the actuator member 104 to seek a centered position where the spring forces on the actuator base 110 will be balanced. Thus the axis C will be aligned with the axis TA. Eliminating off-centering, eliminates any differential in actuation efforts.

The materials chosen for construction of the actuation mechanism 100 are to be those deemed to meet the requirements of the specific application by one skilled in the art. For this particular application, the desire for strength and durability dictates that a high strength material, namely steel, be used in construction of the actuator member 104 because of the repetitious contact between the actuator arm 112 and the carrier 25 upon successive actuations, as described hereinabove. This material is also desirable because it has the strength to resist deflection of the actuator member.

Figure 1A:
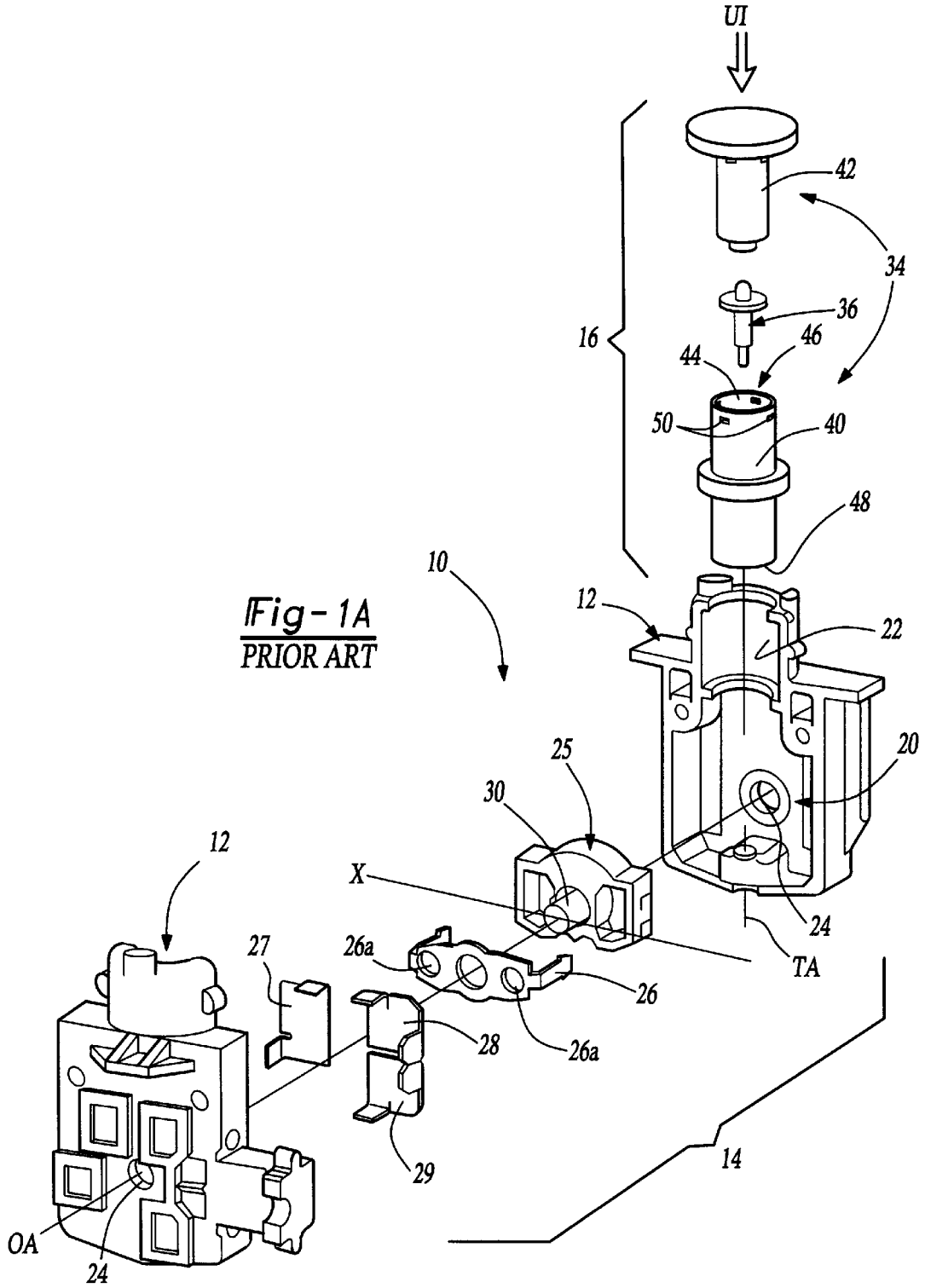
Fig-1A PRIOR ART
FIG. 1A is an exploded perspective view of a prior art alternate action switching device.
Figure 1B:
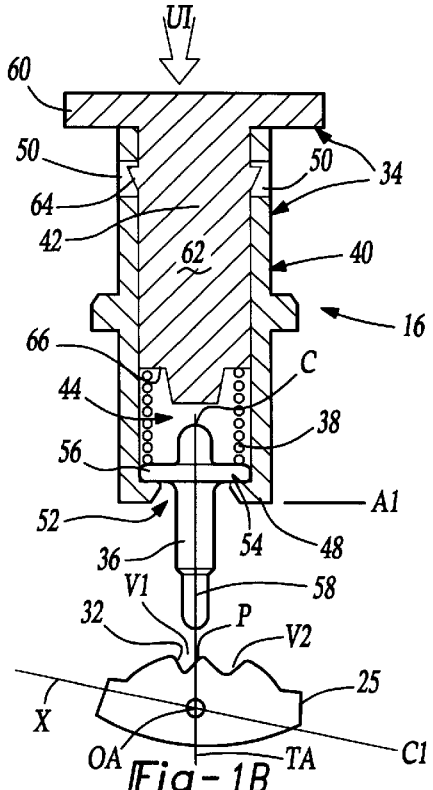
Fig-1B PRIOR ART
FIGS. 1B–1E are cross sectional views of a prior art actuator mechanism in various modes of operation.
Figure 1D:
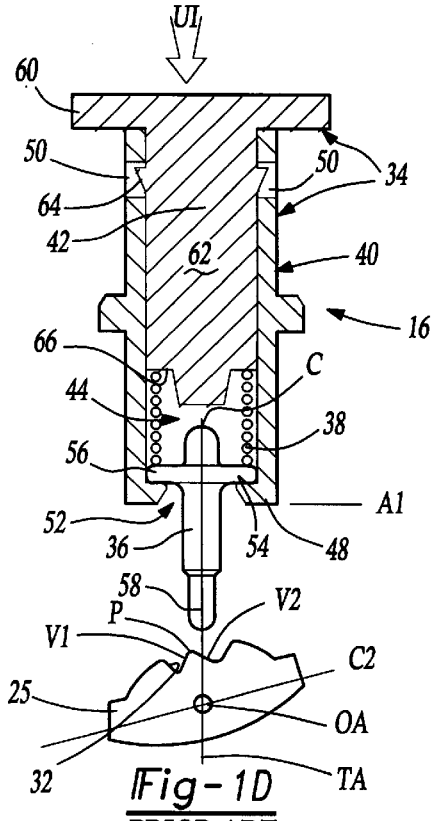
Fig-1D PRIOR ART
Figure 1C:
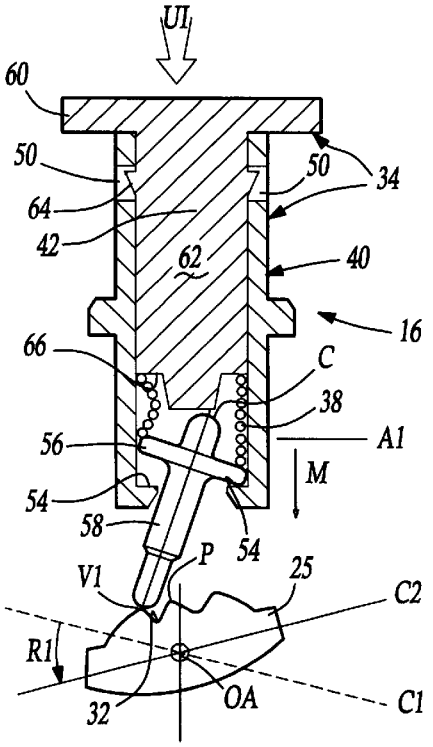
Fig-1C PRIOR ART
Figure 1E:
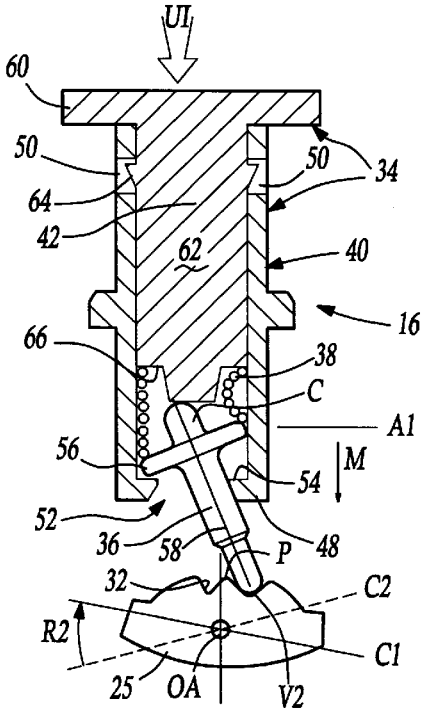
Fig-1E PRIOR ART

The housing cup 102 requires a degree of lubricity so that it can freely slide in the bore 22 of the housing 12 (as shown in FIG. 1A) within in which it travels. For this application, an acetal copolymer or acetal homopolymer housing construction is used because of the self lubricating qualities of the material. The spring 38 may be formed from a commercially available material such as music wire.

It will be understood that various modifications may be made to the embodiments disclosed herein. For example, it will be apparent to those skilled in the art that the shape of the arcuate surfaces is not limited to hemispherical. Furthermore, although the illustration depicts rotary switching device, it is to be understood by one skilled in the art that this is not an exclusive embodiment. A linear switching device or any other similar switching device can be used. In addition, although the actuator mechanism is designed primarily for two state alternate action switching devices, the actuator mechanism could also be used on multi-state switching devices where random selection among the states is desired. Other types of springs may be used such as ground end or wave springs. More than one compression spring may be used if they are concentric and produce the required activation efforts. Furthermore any of the following may be used instead of the spring to urge the base into contact with the cup: air pressure, oil pressure, water pressure, explosives, thermo-nuclear devices, rubber, silicone, or magnetic force.

Therefore, the above description should not be construed as limiting, but merely as exemplifications of preferred embodiments. Those skilled in the art will envision other modifications within the scope and spirit of the claims appended hereto.

We claim:

1. An actuator mechanism for moving a switching device between at least two positions, the actuator mechanism comprising:

a housing structure having a cavity formed therein, an end wall at one end of said cavity, said end wall having an aperture and a first surface circumscribing said aperture, and a cap member at a second end of said cavity and received at least partially within said cavity and fixed to said housing structure;

an actuator member having a base and an arm, said base having a second surface, said arm projecting from said second surface; said actuator member being disposed within said cavity such that said arm extends through said aperture and said first surface and said second surface mate; and centering means for urging said actuator member away from said cap member and for urging said first surface into said second surface to thereby center said actuator arm within said aperture;

whereby upon movement of said housing structure and engagement of said actuator arm with the switching device said second surface remains against and slides along said first surface and said actuator arm moves the switching device between positions, and upon disengagement of said actuator arm from the switching device said centering means centers said actuator arm within said aperture.

2. The actuator mechanism of claim 1, wherein said first surface has a hemispherical contour and said second surface has a complementary hemispherical contour.

3. The actuator mechanism of claim 1, wherein said cap member includes a reaction surface; and wherein said centering means is a spring resting on said actuator base and said reaction surface.

4. The actuator mechanism of claim 3, wherein said spring is a helical compression spring.

5. A switching device comprising:

a housing;

a carrier member pivotally supported within said housing;

an electrical contact member supported on said carrier member for movement with said carrier member;

an actuator received at least partially within said housing and supported for movement relative to said housing, said actuator including a body defining a cavity with an end wall at one end of said body, said end wall having an aperture and a first contoured surface surrounding said aperture, a cap member received at least partially within said cavity at a second end of said cavity, and an actuating member including a base portion received within said cavity and an arm portion extending away from said base portion and protruding at least partially through said aperture, said base portion including a second contoured surface, and a biasing member that biases said actuating member away from said cap member and biases said second surface on said base portion into said first surface;

wherein said biasing member, said first surface and said second surface cooperate to center said actuating member relative to said body when said actuator is in a first position within said housing where said actuator member is spaced from said carrier and wherein said actuating member engages said carrier when said actuator is moved into a second position relative to said housing, said second contoured surface remaining in constant contact with said first contoured surface.

6. The device of claim 5, wherein said first surface is rounded and wherein said second surface is rounded.

7. The device of claim 6, wherein said first surface is generally concave and wherein said second surface is convex.

8. The device of claim 5, wherein said first surface includes a hemispherical contour and wherein said second surface includes a corresponding, mating hemispherical contour.

9. The device of claim 5, wherein said cap member has a first end facing said actuating member and wherein said first end includes a generally cylindrical projection in a central portion of said first end and wherein said biasing member includes a helical spring that is received around said cylindrical portion such that one end of said spring engages said one end of said cap member and a second end of said spring engages a surface on said base portion of said actuating member.

* * * * *